US010067432B2

(12) United States Patent
Noguchi et al.

(10) Patent No.: US 10,067,432 B2
(45) Date of Patent: Sep. 4, 2018

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kazunori Noguchi, Suntou-gun (JP); Harunobu Ogaki, Suntou-gun (JP); Kazumichi Sugiyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/603,042

(22) Filed: May 23, 2017

(65) Prior Publication Data

US 2017/0343909 A1 Nov. 30, 2017

(30) Foreign Application Priority Data

May 27, 2016 (JP) ..... 2016-106455

(51) Int. Cl.

| | |
|---|---|
| ***G03G 5/00*** | (2006.01) |
| ***G03G 5/06*** | (2006.01) |
| ***G03G 5/05*** | (2006.01) |
| ***G03G 15/00*** | (2006.01) |
| ***G03G 5/147*** | (2006.01) |

(52) U.S. Cl.
CPC ..... *G03G 5/0614* (2013.01); *G03G 5/056* (2013.01); *G03G 5/0629* (2013.01); *G03G 5/14752* (2013.01); *G03G 15/75* (2013.01)

(58) Field of Classification Search
CPC ..... G03G 5/0614; G03G 5/14752
USPC ..... 430/66, 59.6
See application file for complete search history.

(56) References Cited

U.S. PATENT DOCUMENTS

| | | | | |
|---|---|---|---|---|
| 2009/0232551 | A1 | 9/2009 | Nagao | |
| 2014/0093818 | A1* | 4/2014 | Ogaki | G03C 1/00 430/56 |

FOREIGN PATENT DOCUMENTS

| | | | |
|---|---|---|---|
| JP | 2006-53549 | A | 2/2006 |
| JP | 2006-221197 | A | 8/2006 |
| JP | 2007-79555 | A | 3/2007 |
| JP | 2008-74714 | A | 4/2008 |
| JP | 4246621 | B2 | 4/2009 |
| WO | 2006/028232 | A1 | 3/2006 |

* cited by examiner

*Primary Examiner* — Mark A Chapman
(74) *Attorney, Agent, or Firm* — Canon U.S.A. Inc., IP Division

(57) ABSTRACT

An electrophotographic photosensitive member includes a surface layer containing a charge transporting material and a specific polyester resin having a structure including a specific branched chain.

8 Claims, 4 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

Aspects of the present disclosure generally relate to an electrophotographic photosensitive member, a process cartridge, and an electrophotographic apparatus.

Description of the Related Art

In electrophotographic processes, recently, an increase in recording speed and an increase in image quality have been increasingly demanded. In order to respond to this, a further improvement in responsiveness and an improvement against causes for degrading image quality, such as a ghost phenomenon, are also desired for electrophotographic photosensitive members. Japanese Patent Application. Laid-Open No. 2008-74714 discusses a technique using a charge transporting material having a high charge mobility in the charge transport layer so as to increase the responsiveness of an electrophotographic photosensitive member.

Furthermore, in a case where the charge transport layer serves as a surface layer or uppermost layer, it is further required to be resistant to externally applied electrical and mechanical forces. Accordingly, Japanese Patent No. 4,246,621 and Japanese Patent Application Laid-Open No. 2006-53549 discuss techniques using a photosensitive member including a surface layer made of a polyester resin having a high mechanical strength. Japanese Patent No. 4,246,621 discusses an electrophotographic photosensitive member including a surface layer made of a polyester resin having a branched-chain structure. Japanese Patent Application Laid-Open No. 2006-53549 discusses an electrophotographic photosensitive member including a surface layer made of a polyester resin containing a diphenyl ether dicarboxylic acid moiety. Any of these discussions describes that the durability of the electrophotographic photosensitive member is improved.

SUMMARY OF THE INVENTION

According to an aspect of the present disclosure, an electrophotographic photosensitive member includes a surface layer containing a charge transporting material and a polyester resin, and the polyester resin has a structure represented by general formula (I) and structure represented by general formula (II):

(I)

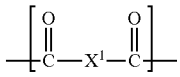

where, in general formula (I), $X^1$ represents a divalent group, and (II)

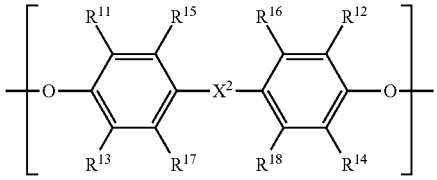

where, in general formula (II), $X^2$ represents a member selected from the group consisting of a single bond, an oxygen atom, a divalent alkylene group, and a divalent cycloalkylene group, and $R^{11}$ to $R^{18}$ each represent one of a hydrogen atom and an alkyl group.

The structure represented by general formula (I) includes a structure represented by formula (I-1):

(I-1)

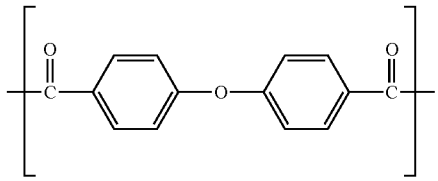

The structure represented by general formula. (II) includes a structure represented by general formula (II-1):

(II-1)

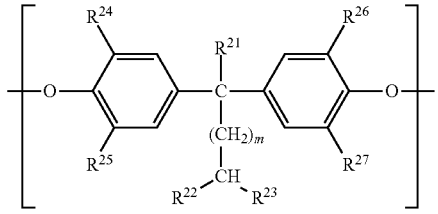

where, in general formula (II-1), $R^{21}$ represents a member selected from the group consisting of a hydrogen atom, a methyl group, an ethyl group, and a phenyl group, $R^{22}$ represents one of a methyl group and an ethyl group, $R^{23}$ represents an alkyl group with a carbon number of 1 to 4, $R^{24}$ to $R^{27}$ each represent one of a hydrogen atom and a methyl group, and m represents a number of repetitions in parentheses and is an integer of 0 to 3.

According to another aspect of the present disclosure, a process cartridge includes and integrally supports the above-mentioned electrophotographic photosensitive member and at least one device selected from the group consisting of a charging device, a developing device, a transfer device, and a cleaning device, and is detachably attachable to an electrophotocraphic apparatus.

According to yet another aspect of the present disclosure, an electrophotographic apparatus includes the above-mentioned electrophotographic photosensitive member, a charging device, as exposure device, a developing device, and a transfer device.

Further features of the present disclosure will become apparent from the following description of exemplary embodiments with reference to the attached drawings.

DESCRIPTION OF THE EMBODIMENTS

Figure 1:
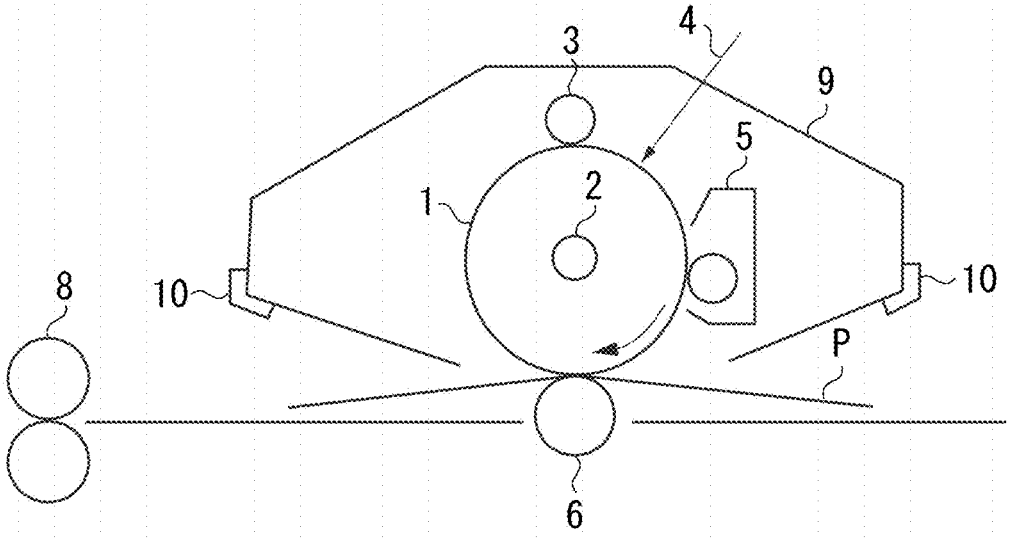
FIG. 1 illustrates an example of a schematic structure of an electrophotographic apparatus provided with a process cartridge.

In an examination by the present inventors, while the electrophotographic photosensitive members using a polyester resin, discussed in the above-cited. Japanese Patent No. 4,246,621 and Japanese Patent Application. Laid-Open No. 2006-53549, exhibited improved durability, the effect of an improvement in responsiveness thereof and the effect of prevention of a ghost phenomenon did not reach the level required in recent years.

Accordingly, aspects of the present disclosure are generally directed to providing an electrophotographic photosensitive member having both a high durability and a high responsiveness with a ghost phenomenon prevented or reduced. Further aspects thereof are directed to providing a process cartridge and an electrophotographic apparatus each of which includes the electrophotographic photosensitive member.

An electrophotographic photosensitive member according to an exemplary embodiment includes a surface layer containing a charge transporting material and a polyester. The polyester resin has a structure represented by general formula (I), which includes a structure represented by formula (I-1), and a structure represented by general formula (II), which includes a structure represented by general formula (II-1):

(I)

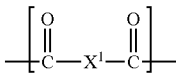

In general formula (I), $X^1$ represents a divalent group. Examples of the divalent group include a phenylene group, biphenylene group, a naphthylene group, an alkylene group, a cycloalkylene group, and a divalent group (-Ph-O-Ph-) having two p-phenylene groups bound with an oxygen atom.

(II)

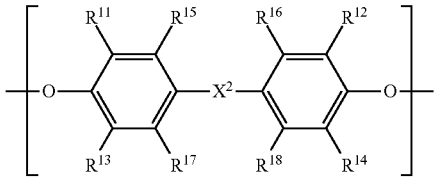

In general formula (II), $X^2$ represents one selected from the group consisting of a single bond, an oxygen atom, a divalent alkylene group, and a divalent cycloalkylene group. $R^{11}$ to $R^{18}$ each represent one of a hydrogen atom and an alkyl group.

(I-1)

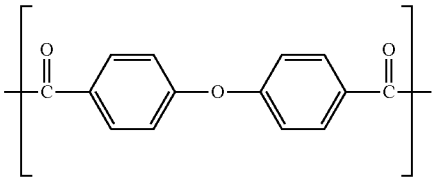

-continued (II-1)

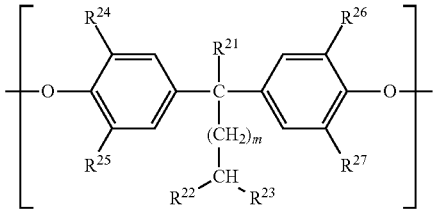

In general formula (II-1), $R^{21}$ represents one selected from the group consisting of a hydrogen atom, a methyl group, an ethyl group, and a phenyl group. $R^{22}$ represents one of a methyl group and an ethyl group. $R^{23}$ represents an alkyl group with a carbon number of 1 to 4 $R^{24}$ to $R^{27}$ each represent one of a hydrogen atom and a methyl group. "m" represents the number of repetitions in parentheses and is an integer of 0 to 3.

Furthermore, the structure represented by general formula (I) is a structure derived from a dicarboxylic acid compound, and the structure represented by general formula (II) is a structure derived from a bisphenol compound (a compound having two hydroxyphenyl groups). These structures form an ester bond with the compounds from which these structures are derived reacting with each other, thus representing the following structural unit:

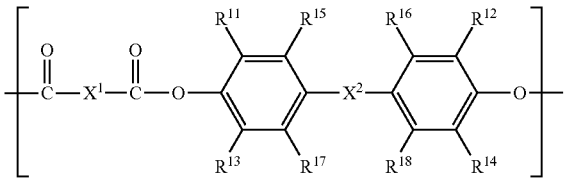

The present inventors assume that the reason why both a high durability and a high responsiveness satisfied and a ghost phenomenon is prevented or reduced by using the above-described polyester resin for the surface layer contathina a charge transporting material is as described below.

To attain a high durability, it was previously considered that using a material having high stacking performance and high rigidity, such as a phenylene group, for the surface layer was desirable. However, it is assumed that, when a charge transporting material is used, using only a structure having high stacking performance and high rigidity may allow the stacking performance and rigidity of a resin to restrict the movement of the charge transporting material.

Therefore, an improvement in charge mobility was attempted by introducing a bulky branched-chain structure such as that represented by general formula (II-1) into the resin chain, but merely introducing the branched-chain structure was insufficient to satisfy both high durability and high responsiveness as intended.

In the present exemplary embodiment, it is considered that introducing a structure represented formula (I-1) and a structure represented by general formula (II-1) the same resin chain enables forming a resin having a bulky moiety and a structure in which both rigidity and flexibility are satisfied, so that both high durability and high responsiveness can be satisfied. Moreover, with regard to a ghost phenomenon being prevented or reduced, not only an improvement in charge mobility but also a restriction of staying of charges can be considered.

The structure represented by formula (I-1) is considered to be a diphenyl ether structure in which benzene rings having high rigidity are bound with an ether group, thus having high flexibility.

The polyester resin in the present exemplary embodiment having a structure represented by formula (I-1) as the structure represented by general formula (I) can produce advantageous effects in the present exemplary embodiment. Furthermore, it is desirable that the proportion of the moles of the structure represented by formula (I-1) to the moles of the structure represented by general formula (I) be 30% by mole or more in general formula (I), so that the charge mobility, which is an index indicating the responsiveness of an electrophotographic photosensitive member, can be increased.

Moreover, the polyester resin can have a structure represented by general formula (I) other than the structure represented by formula (I-1). More specifically, examples of the structure include a structure derived from a carboxylic acid, such as terephthalic acid, isophthalic acid, biphenyl dicarboxylic aliphatic dicarboxylic acid, and naphthalene dicarboxylic acid. More specifically, the following structural examples can be taken:

(I-2)

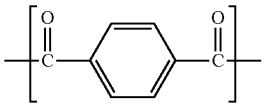

(I-3)

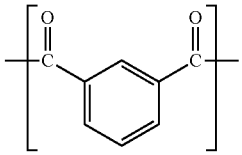

(I-4)

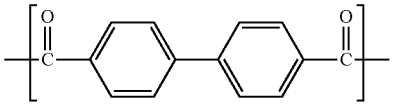

Among others, a structure copolymerized with a terephthalic acid structure represented by formula (I-2) is desirable from the viewpoint of keeping high charge mobility. The copolymer formed with above-described structures can be in any form, such as block copolymer, random copolymer, or alternating copolymer.

Specific examples of the structure represented by general formula (II-1) are shown as follows:

(II-1-1)

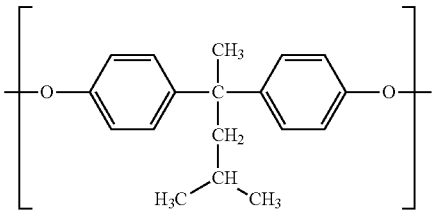

-continued (II-1-2)

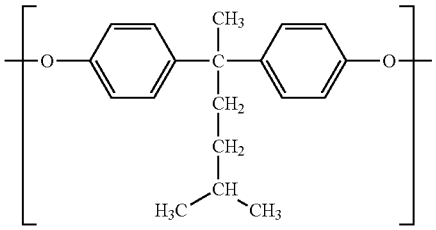

(II-1-3)

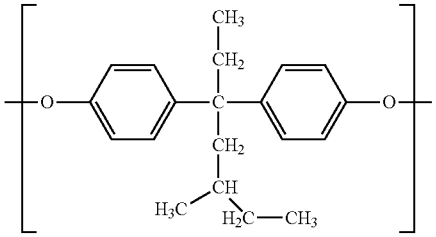

(II-1-4)

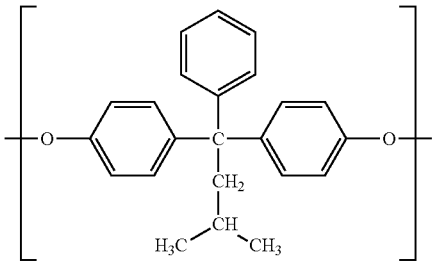

(II-1-5)

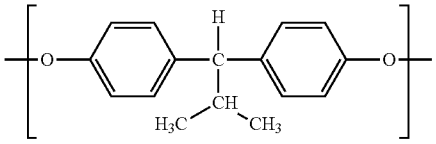

(II-1-6)

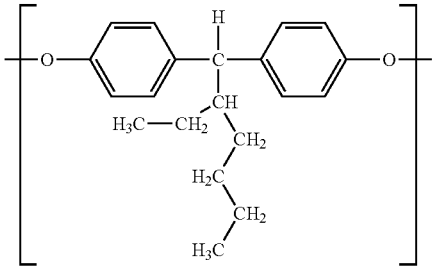

Among others, a structure represented by formula (II-1-1) is desirable from the viewpoint of satisfying both high and high charge mobility and preventing or reducing a ghost phenomenon.

In the polyester resin, it is desirable that the proportion of the moles of the structure represented by general formula (II-1) to the moles of the structure represented by general formula (II) be 30% by mole or more, from the viewpoint of attaining high charge mobility. Furthermore, it is desirable that the proportion be 40% by mole or more and 80% by mole or less, from the viewpoint of satisfying both high durability and high charge mobility and preventing or reducing a ghost phenomenon.

Moreover, it is desirable that the polyester resin have a structure represented by general formula (II-2) as the structure represented by general formula (II). In other words, it is desirable that the polyester resin have a structure represented by general formula (II-1) and a structure represented by general formula (II-2) as the structure represented by general formula (II).

(II-2)

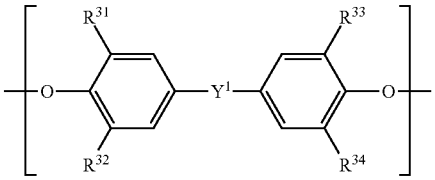

In general formula (II-2), $R^{31}$ to $R^{34}$ each represent one of a hydrogen atom and an alkyl group. $Y^1$ represents selected from the group consisting of a single bond, an oxygen atom, a divalent alkylene group, and a divalent cycloalkylene group.

Specific examples of the structure represented by general formula (II-2) are shown as follows:

(II-2-1)

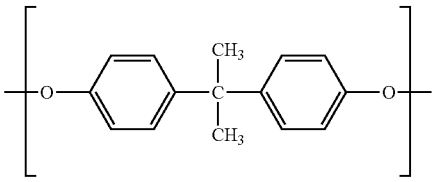

(II-2-2)

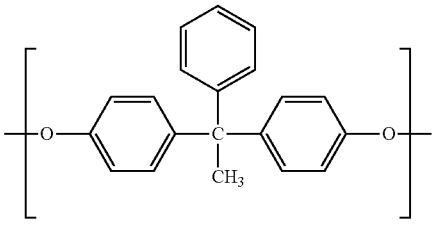

(II-2-3)

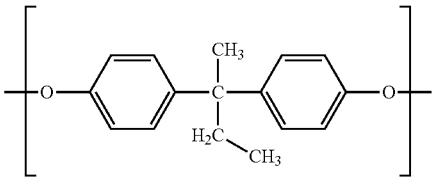

(II-2-4)

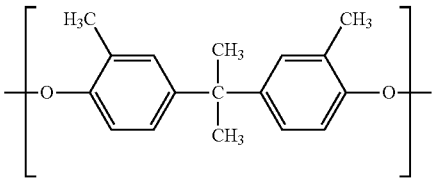

(II-2-5)

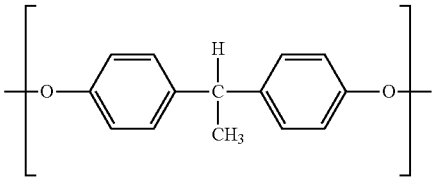

-continued (II-2-6)

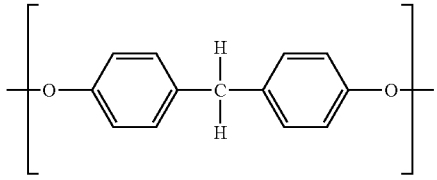

(II-2-7)

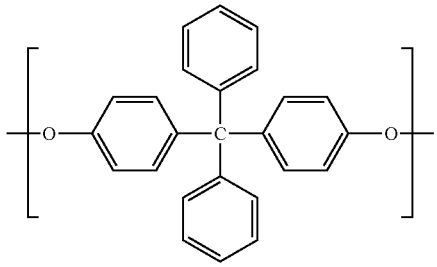

(II-2-8)

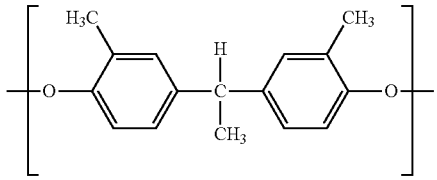

(II-2-9)

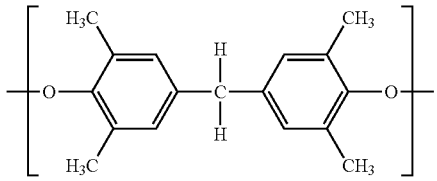

(II-2-10)

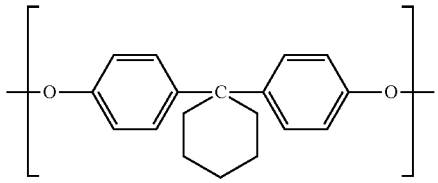

(II-2-11)

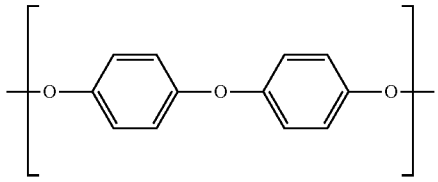

(II-2-12)

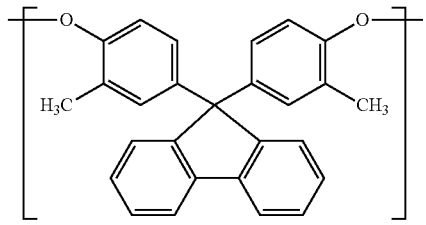

-continued (II-2-13)

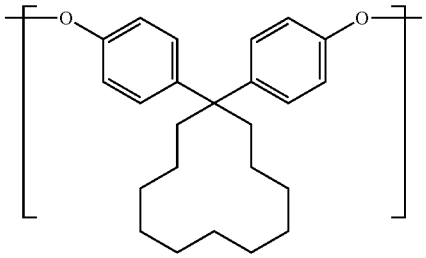

(II-2-14)

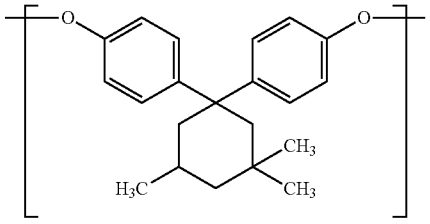

(II-2-15)

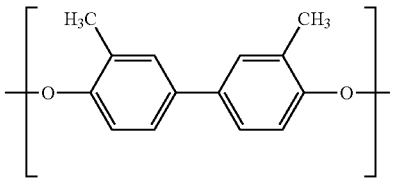

(II-2-16)

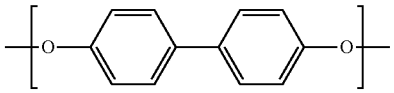

(II-2-17)

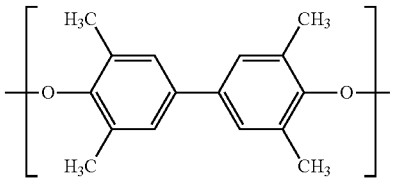

(II-2-18)

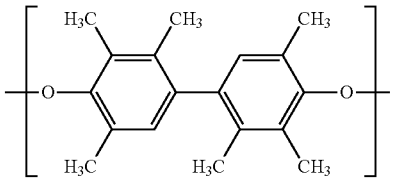

In the present exemplary embodiment, it is desirable that, in general formula (II-2), $Y^1$ be a single bond. In other words, it is desirable that the polyester resin have a structure represented by formula (II-2-15), (II-2-16), (II-2-17), or (II-2-18), from the viewpoint of attaining high durability. In particular, it is desirable that the polyester resin have a structure represented by formula (II-2-17), from the viewpoint of satisfying both high durability and high responsiveness and preventing ar reducing a ghost phenomenon. The copolymer formed with above-described structures can be in any form, such as block copolymer, random copolymer, or alternating copolymer, but a random copolymer is particularly desirable from the viewpoint of attaining high responsiveness.

Furthermore, in the polyester resin, it is desirable that the proportion of the moles of the structure represented by general formula (II-1) to the moles of the structure represented by general formula (II) be 30% mole or more and 60% by mole or less, and the proportion of the moles of the structure represented by formula (II-2-16) the moles of the structure represented by general formula (II) be 30% by mole or more and 60% by mole or less. Meeting these conditions enables satisfying both high charge mobility and high durability.

The surface layer can contain any resin other than the above-described polyester resin as a binder resin. Examples of such resins include polycarbonate resin, polymethacrylic acid ester resin, polysulfone resin, and polystyrene resin. Some of these resins may be mixed or copolymerized. If any of these resins other than the polyester resin s used, it is desirable that the proportion of the mass of the above-described polyester resin in the present exemplary embodiment to the total mass of the binder resins be 50% by mass or more.

The weight average molecular wei of the binder resin is desirably in the range of 60,000 to 200,000, more desirably in the range of 80,000 to 150,000. This weight average molecular weight refers to the polystyrene-equivalent weight average molecular weight measured by the method discussed in Japanese Patent Application Laid-Open No. 2007-79555.

[Electrophotographic Photosensitive Member]

The electrophotographic photosensitive member according to an exemplary embodiment includes a surface layer containing a charge transporting material. The electrophotographic photosensitive member can further include a support member and a photosensitive layer. The photosensitive layer of the electrophotographic photosensitive member is classified into a multilayer photosensitive layer (1) and a single-layer photosensitive layer (2). The multilayer photosensitive layer (1) includes a charge generating layer containing a charge generating material, and a charge transport layer containing a charge transporting material. The single-layer photosensitive layer (2) is a photosensitive layer containing a charge generating material and a charge transporting material together. In the present exemplary embodiment, in the case of using a multilayer photosensitive layer (1), the surface layer containing a charge transporting material serves as the charge transport layer, and, in the case of using a single-layer photosensitive layer (2), the surface layer containing a charge transporting material serves as the photosensitive layer. These layers are described as follows.

The electrophotographic photosensitive member can produced by applying each of coating liquids prepared for forming the layers thereof, which are described below, in an intended order of layers, and drying the coatings. The coating liquids can be applied by dipping (dip coating), spray coating, curtain coating, or spin coating. From viewpoint of efficiency and productivity, dipping is desirable.

<Support Member>

In an exemplary embodiment, the electrophotographic photosensitive member can include a support member. Desirably, the support member is a conductive support member having electrical conductivity. Examples of the conductive support member include a support member made of a metal, such as aluminum, iron, nickel, copper, or gold, or an alloy thereof, and a support member having a thin film made of a metal, such as aluminum, chromium, silver, or gold, a thin film made of an electrically conductive material, such as indium oxide, tin oxide, or zinc oxide, or a thin film of an electrically conductive ink containing silver nanowires, formed on an insulating support member made of, for example, a polyester resin, a polycarbonate resin, a polyimide resin, or class.

The support member can be subjected to surface treatment by electrochemical operation such as anodization, or wet honing, blast or cutting to improve the electrical properties and prevent the occurrence of interference fringes.

The support member can be in the form of, for example, a cylinder, a belt, or a film.

<Electroconductive Layer>

In an exemplary embodiment, an electroconductive layer can be provided on the support member. The average film thickness of the electroconductive layer can be desirably in the range of 0.2 μm to 40 μm, more desirably in the range of 1 μm to 35 μm, or, particularly desirably in the range of 5 μm to 30 μm.

The electroconductive layer can contain metal oxide particles and a binder resin. Examples of the metal oxide of the metal oxide particles include zinc oxide, white lead, aluminum oxide, indium oxide, silicon oxide, zirconium oxide, tin oxide, titanium oxide, magnesium oxide, antimony oxide, bismuth oxide, tin-doped indium oxide, antimony- or tantalum-doped tin oxide, and zirconium oxide. In these metal oxide particles, particles of zinc oxide, titanium oxide, or tin oxide are desirable. The number average particle size of the metal oxide articles can be desirably in the range of 30 nm to 450 nm, more desirably in the range of 30 nm to 250 nm, from the viewpoint of preventing local formation of conductive paths that is a cause of black points.

Examples of the binder resin include a polyester resin, a polycarbonate resin, a polyvinyl butyral resin, an acrylic resin, a silicone resin, an epoxy resin, a melamine resin, a urethane resin, a phenol resin, and an alkyd resin.

The electroconductive layer can be formed by applying a coating liquid prepared for the electroconductive layer onto the support member. The coating liquid for the electroconductive layer can contain a solvent in addition to the metal oxide particles and the binder resin. Examples of the solvent include an alcohol based solvent, a sulfoxide-based solvent, a ketone-based solvent, an ether-based solvent, an ester-based solvent, and an aromatic hydrocarbon solvent. The metal oxide particles are dispersed in the coating liquid by using, for example, a paint shaker, a sand mill, a ball mill, or a high-speed liquid collision disperser. Moreover, the metal oxide particles can be surface-treated with, for example, silane coupling agent so as to be highly dispersed. Furthermore, the metal oxide particles can be doped with another metal or metal oxide to regulate the resistance of the electroconductive layer.

<Undercoat Layer>

In an exemplary embodiment, an undercoat layer can be provided the support member or the electroconductive layer. The undercoat layer acts as a barrier and enhances adhesion. The average film thickness of the undercoat layer can be desirably in the range of 0.05 μm to 40 μm, more desirably in the range of 0.05 μm to 7 μm, or particularly desirably in the range of 0.1 μm to 2 μm.

It is advantageous for preventing charges generated from the charge generating layer from staying there that the undercoat layer contains an electron transporting material and a binder resin. Since such an undercoat layer allows the electrons of the charges generated from the charge generating layer to transported to the support member, the deactivation of charges in the charge generating layer and an increase in traps can be prevented even if the charge transport ability of the charge transport layer is increased. Thus, electrical properties at the beginning and during repeated use are improved.

Examples of the electron transporting material include quinone compounds, imide compounds, benzimidazole compounds, cyclopentadiene lidene compounds, fluorenone compounds, xanthone-based compounds, benzophenone-based compounds, cyanovinyl-based compounds, naphthylamide compounds, and peryleneimide compounds. The electron transporting material can have a polymerizable functional group, such as a hydroxy group, a thiol group, an amino group, a carboxy group, or a methoxy group.

Examples of the binder resin include polyacrylic acid-based resin, methyl cellulose, ethyl cellulose, polyamide resin, polyimide resin, poly (amide-imide) resin, polyamide acid resin, urethane resin, melamine resin, and epoxy resin. Moreover, the binder resin can be a polymer having a cross-linked structure formed by thermally polymerizing (curing) a thermosetting resin having a polymerizable functional group, such as acetal resin or alkyd resin, and a monomer having a polymerizable functional group, such as an isocyanate compound.

The undercoat layer can be formed by applying a coating liquid for forming the undercoat layer containing a binder resin, and drying the coating.

<Photosensitive Layer>

(1) Multilayer Photosensitive Layer

If the photosensitive layer has a multilayer structure, the electrophotographic photosensitive member includes a charge generating layer containing a charge generating material, and a charge transport layer containing a charge transporting material and a polyester resin having a structure represented by general formula (I) and a structure represented by general formula (II).

(1-1) Charge Generating Layer

The average film thickness of the charge generating layer can be desirably in the range of 0.05 μm to 5 μm, more desirably in the range of 0.05 μm to 1 μm, or particularly desirably in the range of 0.1 μm to 0.3 μm.

Examples of the charge generating material include azo pigments, perylene pigments, anthraquinone derivatives, anthanthrone derivatives, dibenzpyrenequinone derivatives, pyranthrone derivatives, violanthrone derivatives, isoviolanthrone derivatives, indigo derivatives, thioindigo derivatives, phthalocyanine pigments, and bisbenzimidazole derivatives. Among these, azo pigments and phthalocyanine pigments are desirable. Desirable phthalocyanine pigments include oxytitanium phthalocyanine, chlorogallium phthalocyanine, and hydroxygallium phthalocyanine.

Examples of the binder resin used in the charge generating layer include polymers or copolymers of vinyl compounds, such as styrene, vinyl acetate, vinyl chloride, acrylic acid esters, methacrylic acid esters, vinylidene fluoride, and trifluoroethylene; and polyvinyl alcohol resin, polyvinyl acetal resin, polycarbonate resin, polyester resin, polysulfone resin, polyphenylene oxide resin, polyurethane resin, cellulose resin, phenol resin, melamine resin, silicone resin, and epoxy resin. Among these, polyester resin, polycarbonate resin, and polyvinyl acetal resin are desirable, and polyvinyl acetal resin is more desirable.

The charge generating material content in the charge generating layer is desirably in the range of 30% by mass to 90% by mass, or more desirably in the range of 50% by mass to 80% by mass, relative to the total mass of the charge generating layer.

In the charge generating layer, the mass ratio of the charge generating material to the binder resin (mass of the charge generating material/mass of the binder resin) is desirably in the range of 10/1 to 1/10, or more desirably in the range of 5/1 to 1/5.

The charge generating layer can be formed by applying a coating liquid for the charge generating layer prepared by mixing a charge generating material and a binder resin with a solvent, and drying the coating. Examples of the solvent used in the coating liquid for the charge generating layer include an alcohol-based solvent, sulfoxide-based solvent, a ketone-based solvent, an ether based solvent, an ester-based solvent, and an aromatic hydrocarbon solvent.

(1-2) Charge Transport Layer

The film thickness of the charge transport layer is desirably in the range of 5 μm to 50 μm, or more desirably in the range of 10 μm to 35 μm.

Examples of the charge transporting material in the charge transport layer include polycyclic aromatic compounds, heterocyclic compounds, hydrazone compounds, styryl compounds, enamine compounds, benzidine compounds, triarylamine compounds, and triphenylamine. Furthermore, the charge transporting material can be a polymer having a group derived from these compounds in the main chain or a side chain. Among these, triarylamine compounds and benzidine compounds are desirable in terms of potential stability during repeated use. A plurality of types of charge transporting materials can be contained in combination. Specific examples of the charge transporting material are shown as follows.

(CTM-1)

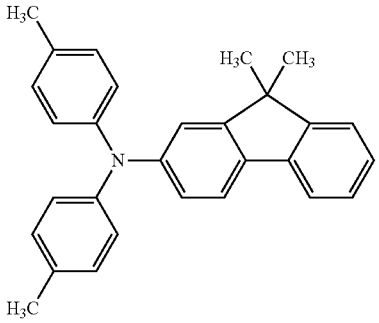

(CTM-2)

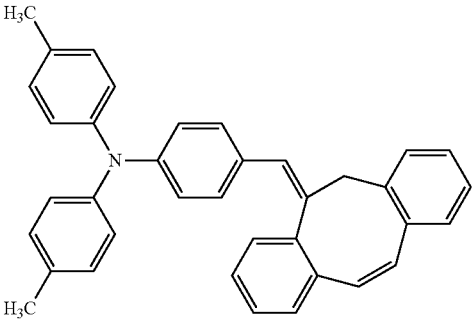

(CTM-3)

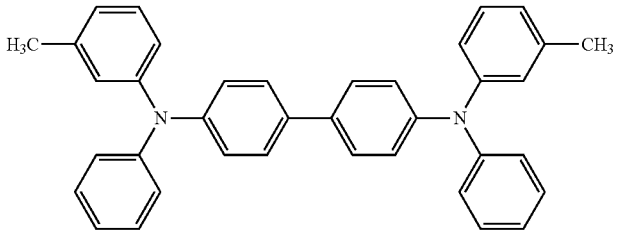

(CTM-4)

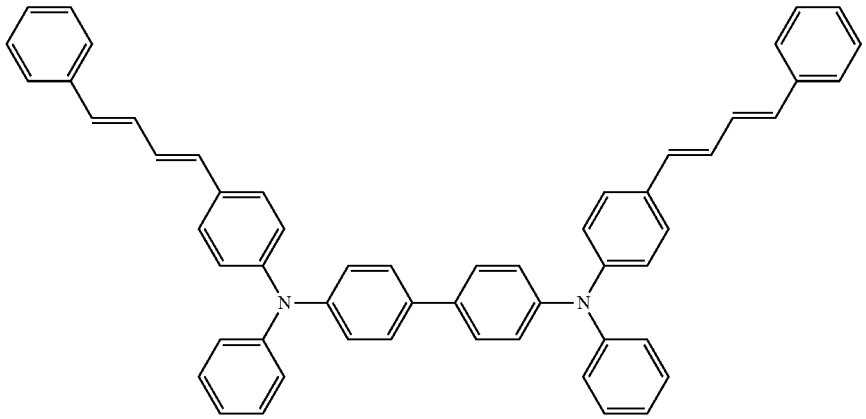

(CTM-5)

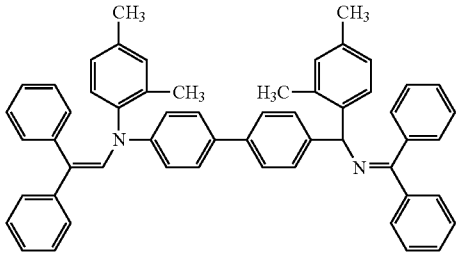

(CTM-6)

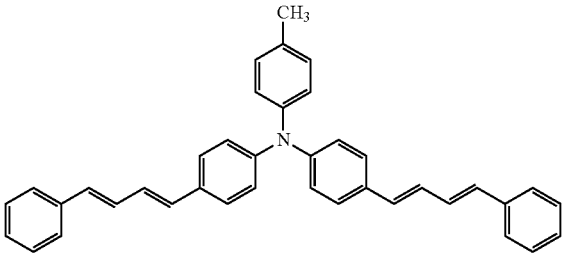

-continued (CTM-7)

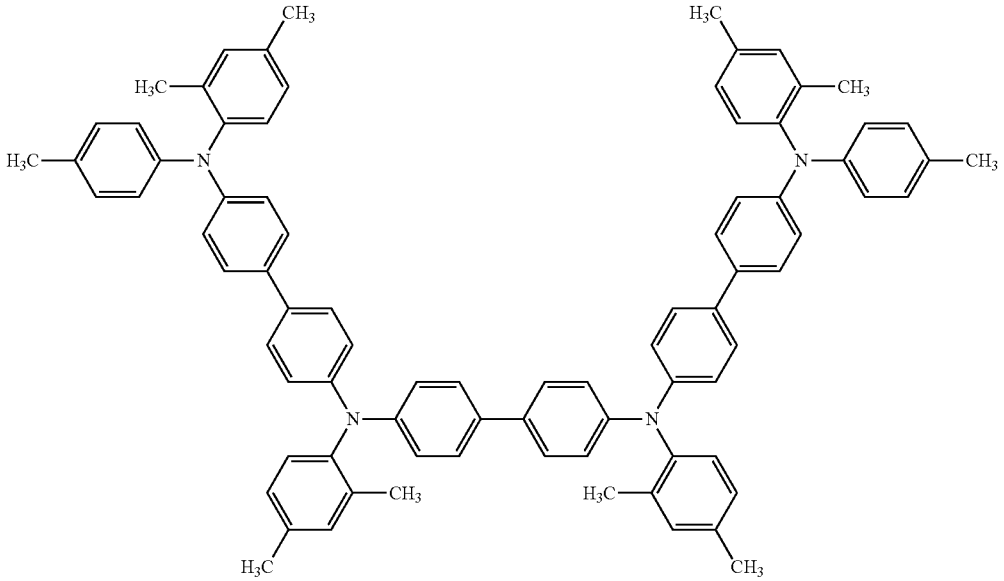

(CTM-8)

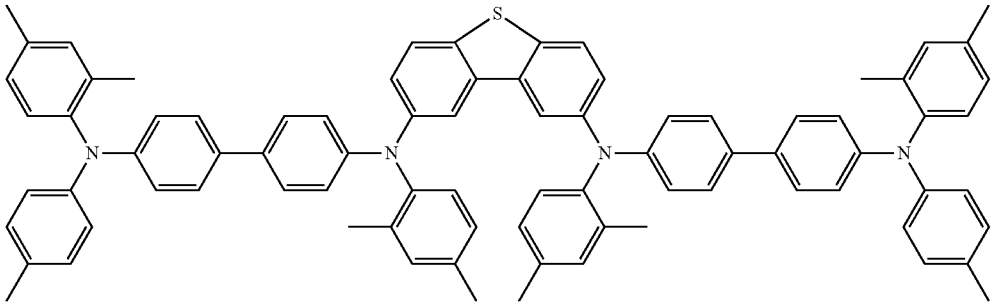

(CTM-9)

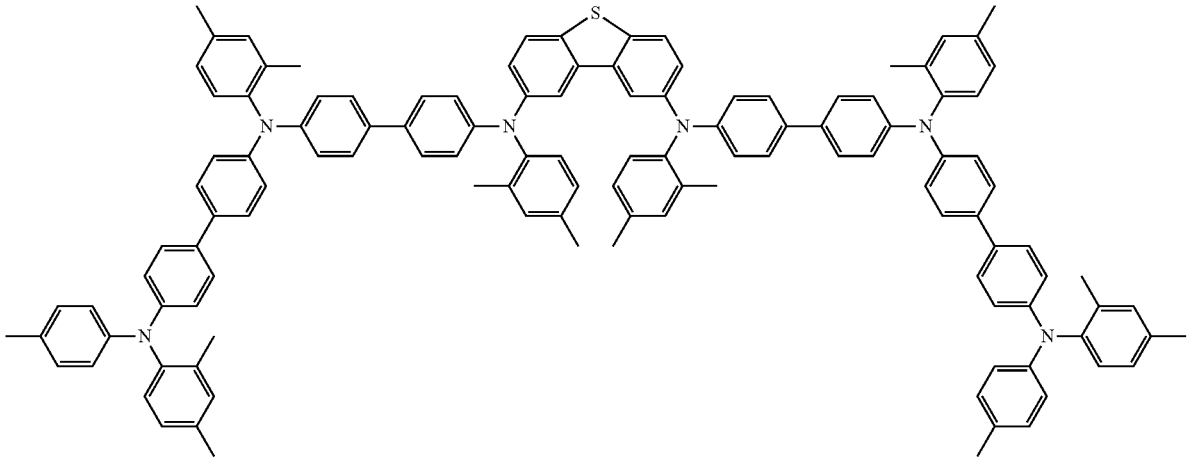

Examples of the binder resin used in the charge transport layer include polyester, acrylic resin, phenoxy resin, polycarbonate, polystyrene, polyvinyl acetate, polysulfone, polyarylate, vinylidene chloride, and acrylonitrile copolymer. Among these, polycarbonate and polyarylate are desirable.

The charge transporting material content in the charge transport layer is desirably in the range of 20% by mass to 80% by mass, or more desirably in the range of 30% by mass to 60% by mass, relative to the total mass of the charge transport layer.

The charge transport layer can be formed by applying a coating liquid for the charge transport layer prepared by dissolving a charge transporting material and a binder resin in a solvent, and drying the coating. Examples of the solvent used in the coating liquid for forming the charge transport layer include an alcohol-based solvent, a sulfoxide-based solvent, a ketone-based solvent, an ether-based solvent, an ester-based solvent, and an aromatic hydrocarbon solvent.

(2) Single-layer Photosensitive Layer

If the photosensitive layer has a single-layer structure, the photosensitive layer contains a charge generating material, a charge transporting material, and a polyester resin having a structure represented by general formula (I) and a structure represented by general formula (II). The photosensitive layer can be formed by applying a coating liquid for the photosensitive layer prepared by dissolving the charge generating material, the charge transporting material, and a binder resin in a solvent, and drying the coating. The charge transporting material and the binder resin can be selected from among the same materials cited in "(1) Multilayer Photosensitive Layer".

<Protective Layer>

The surface layer can be covered with a protective layer as long as the advantageous effect of the present exemplary embodiment can be produced. Desirably, the protective layer can contain electrically conductive particles or a charge transporting material and a binder resin. The protective layer can further contain an additive, such as a lubricant. The binder resin in the protective layer can have electrical conductivity or charge transporting ability. Furthermore, in this instance, electrically conductive particles or a charge transporting material does not need to be added to the protective layer. Moreover, the binder resin in the protective layer can be a thermoplastic resin, or can be a resin cured by heat light, or radiation (e.g., electron beam).

[Process Cartridge and Electrophotographic Apparatus]

The process cartridge according to an exemplary embodiment includes and integrally supports the above-described electrophotographic photosensitive member and at least one device selected from the group consisting of a charging device, a developing device, a transfer device, and a cleaning device, and is detachably attachable to an electrophotographic apparatus.

Furthermore, the electrophotographic apparatus according to an exemplary embodiment includes the above-described electrophotographic photosensitive member, a charging device, an exposure device, a developing device, and a transfer device.

FIG. 1 illustrates an example of a schematic structure of an electrophotographic apparatus provided with a process cartridge including an electrophotographic photosensitive member.

Referring to FIG. 1, the electrophotographic photosensitive member 1 in a cylindrical shape is driven for rotation around an axis 2 in the direction indicated by an arrow at a predetermined peripheral speed. The surface (periphery) of the electrophotographic photosensitive member 1 driven for rotation is uniformly charged to a predetermined positive or negative potential by a charging device 3 (a primary charging device such as a charging roller). Then, the surface or periphery is subjected to exposure (image exposure) 4 from an exposure device (not illustrated), such as a slit exposure or laser beam scanning exposure device. In this way, electrostatic latent images corresponding to intended images are sequentially formed one after another on the surface of the electrophotographic photosensitive member 1.

The electrostatic latent images formed on the surface of the electrophotographic photosensitive member 1 are then developed with the toner contained in the developer of the developing device 5, thus forming toner images on the electrophotographic photosensitive member 1. Subsequently, the toner images on the surface of the electrophotographic photosensitive member 1 are transferred to a transfer medium P, such as a paper sheet, one after another from a transfer device 6, such as a transfer roller. The toner images on the surface of the electrophotographic photosensitive member 1 can be transferred once to an intermediate transfer member and then to the transfer medium such as a paper sheet. The transfer medium P is fed to an abutting portion between the electrophotographic photosensitive member 1 and the transfer device 6 from a transfer medium feeder (not illustrated) in synchronization with the rotation of the electrophotographic photosensitive member 1.

The transfer medium P to which the toner images have been transferred is separated from the surface of the electrophotographic photosensitive member 1 and is then introduced into a fixing device 8, in which the toner images are fixed, thus being elected as an image-formed article (printed material or copy) to the outside of the apparatus.

The surface of the electrophotographic photosensitive member 1 after the toner images have been transferred is cleaned with a cleaning device 7, such as a cleaning blade, to remove the developer (toner) remaining after transfer from the surface of the electrophotographic photosensitive member 1. Subsequently, the electrophotographic photosensitive member 1 is subjected to pre-exposure (not illustrated) with a pre-exposure device (not illustrated) to remove static electricity before being reused to form images. If the charging device 3 is of the contact charging type, as a charging roller as illustrated in FIG. 1, however, pre-exposure is not necessarily required.

Some of the components of the electrophotographic apparatus including the electrophotographic photosensitive member 1, the charging device 3, the developing device 5, the transfer device 6, and the cleaning device 7 can be integrally combined in a single container serving as a process cartridge. The process cartridge can be configured to be detachably attachable to an electrophotographic apparatus, such as a copying machine or a laser beam printer. In the exemplary embodiment illustrated in FIG. 1, the electrophotographic photosensitive member 1, the charging device 3, developing device 5, and the cleaning device 7 are integrated into a cartridge. The cartridge is guided by a guide 10 such as a rail of the electrophotographic apparatus body, thus being used as a removable process cartridge 9 in the electrophotographic apparatus.

EXAMPLES

The subject matter of the present exemplary embodiment is further described in detail with reference to Examples and Comparative Examples. The subject matter is however not limited to the following Examples. In the following Examples, "part(s)" is on a mass basis unless otherwise specified.

<Synthesis of Polyester Resin>

Synthesis Example 1

Synthesis of Polyester Resin A

An acid halide solution was prepared by dissolving 42.2 g of a dicarboxylic acid halide in dichloromethane. The dicarboxylic acid halide is represented by the following formula:

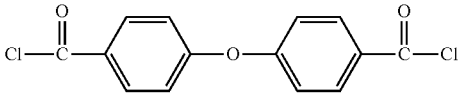

Moreover, a diol compound solution was prepared by dissolving 38.7 g of a dial represented by the following formula in 10% aqueous solution of sodium hydroxide and stirring the solution in the presence of tributylbenzylammonium chloride added as a polymerization catalyst:

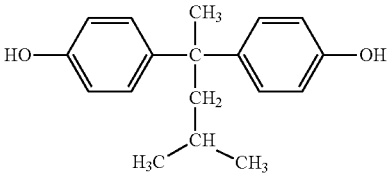

Then, the above acid halide solution was added to the diol compound solution while being stirred, so that a polymerization was started. The polymerization was made at the reaction temperature kept at 25° C. or less for 3 hours together with stirring. During the polymerization reaction, p-tent-butylphenol was added as a polymerization regulator. Then, acetic acid was added to terminate the polymerization reaction, and the reaction solution was repeatedly washed with water until the aqueous phase was turned neutral. After washing, the dichloromethane solution was dropped into methanol to precipitate a polymerization product, and the polymerization product was vacuum-dried to yield 65.8 g of polyester resin A. The yielded polyester resin A was a polyester resin having a structure represented by formula (I-1) and a structure represented by formula (II-1-1). Moreover, the yielded polyester resin A had a weight average molecular weight of 120,000.

Synthesis Examples 2 to 22

Polyester resins B to P and CE-1 to CE-5 shown in Table 1 were synthesized in the same manner as in Synthesis Example 1.

TABLE 1

Polyester Resin Synthesis Examples

| Synthesis Example No. | Polyester resin No. | Structures (type and mole percent) of resin: Structure represented by general formula (I) | Structures (type and mole percent) of resin: Structure represented by general formula (II) | Weight: average molecular weight of resin |
|---|---|---|---|---|
| Synthesis Example 1 | A | I-1 | II-1-1 | 120,000 |
| Synthesis Example 2 | B | I-1 | II-1-2 | 110,000 |
| Synthesis Example 3 | C | I-1 | II-1-3 | 110,000 |
| Synthesis Example 4 | D | I-1 | II-1-4 | 80,000 |
| Synthesis Example 5 | E | I-1 | II-1-5 | 100,000 |
| Synthesis Example 6 | F | I-1 | II-1-6 | 150,000 |
| Synthesis Example 7 | G | I-1 | II-1-1/II-2-17(40/60) | 100,000 |

TABLE 1-continued

Polyester Resin Synthesis Examples

| Synthesis Example No. | Polyester resin No. | Structures (type and mole percent) of resin: Structure represented by general formula (I) | Structures (type and mole percent) of resin: Structure represented by general formula (II) | Weight: average molecular weight of resin |
|---|---|---|---|---|
| Synthesis Example 8 | H | I-1 | II-1-1/II-2-17(70/30) | 120,000 |
| Synthesis Example 9 | I | I-1 | II-1-1/II-2-17/II-2-4(30/40/30) | 110,000 |
| Synthesis Example 10 | J | I-1/I-2 (70/30) | II-1-1/II-2-17(40/60) | 110,000 |
| Synthesis Example 11 | K | I-1/I-3 (70/30) | II-1-1/II-2-17(40/60) | 100,000 |
| Synthesis Example 12 | L | I-1/I-2 (70/30) | II-1-1/II-2-17(60/40) | 100,000 |
| Synthesis Example 13 | M | I-1 | II-1-1/II-2-8(40/60) | 120,000 |
| Synthesis Example 14 | N | I-1 | II-1-1/II-2-15(80/20) | 100,000 |
| Synthesis Example 15 | O | I-1 | II-1-1/II-2-9(50/50) | 110,000 |
| Synthesis Example 16 | P | I-1/I-2 (50/50) | II-1-1/II-2-15(80/20) | 110,000 |
| Synthesis Example 17 | Q | I-1/I-24 (90/10) | II-1-2 | 100,000 |
| Synthesis Example 18 | CE-1 | I-2 | II-1-1/II-2-9(50/50) | 110,000 |
| Synthesis Example 19 | CE-2 | I-2 | II-1-1 | 130,000 |
| Synthesis Example 20 | CE-3 | I-1 | II-2-8 | 100,000 |
| Synthesis Example 21 | CE-4 | I-2 | II-2-8 | 130,000 |
| Synthesis Example 22 | CE-5 | I-2 | II-1-1/II-2-17(40/60) | 110,000 |

In Table 1, the weight average molecular weight of resin indicates the polystyrene equivalent weight average molecular weight (Mw) of each polyester resin.

The proportion or percentage of each structure contained in the polyester resin included in the surface layer can be determined by a conventional analytical method. The content percentage of the polyester resin in the present embodiment to the total mass of all of the resins in the surface layer can also be determined by a conventional analytical method. An exemplary analytical method is described as follows.

First, the surface layer of the electrophotographic photosensitive member is dissolved in a solvent. Subsequently, the constituents of the surface layer are separated and collected by a size exclusion chromatograph, a high-performance liquid chromatograph, or any other apparatus that can separate and collect the constituents. The polyester resin thus separated and collected was subjected to nuclear magnetic resonance spectral analysis and mass spectroscopy for calculating the number of repetitions and the mole percentage of each structure.

Alternatively, the polyester resin can be hydrolyzed into a carboxylic acid portion and a bisphenol portion, for example, in the presence of an alkali. The bisphenol portion thus obtained was subjected to nuclear magnetic resonance spectral analysis and mass spectroscopy for calculating the number of repetitions and the mole percentage of the structure.

<Preparation of Electrophotographic Photosensitive Member>

Example 1

An aluminum cylinder of 24 mm in diameter and 257 mm in length was used as a support member (electrically conductive support member).

Then, 214 parts of titanium oxide ($TiO_2$) particles coated with oxygen-deficient tin oxide ($SnO_2$), serving as metal oxide particles, 132 parts of a phenol resin (monomer or oligomer of a phenol resin) (product name: Plyophen J-325, manufactured by DIC, resin solids content: 60% by mass), serving as a binder material, and 98 parts of 1-methoxy-2-propanol, serving as a solvent, were added into a sand mill containing 450 parts of glass beads of 0.8 mm in diameter, and were dispersed in each other at a rotational speed of 2000 rpm with cooling water set 18° C. for 4.5 hours to yield a dispersion liquid. The glass beads were removed from the dispersion liquid through a mesh (openings: 150 μm).

Silicone resin particles (product name: Tospearl 120, manufactured by Momentive Performance Materials Japan LLC, average particle size: 2 μm), serving as a surface roughening material, were added to the dispersion liquid. The additive amount of the silicone resin particles at that time was set to 10% by mass relative to the total mass of the metal oxide particles and the binder material in the dispersion liquid from which the glass beads had been removed. Moreover, a silicone oil (product code: SH28PA, manufactured by Dow Corning Toray), serving as a leveling agent, was added to the dispersion liquid in a proportion of 0.01% by mass relative to the total mass of the metal oxide particles and the binder material in the dispersion liquid, and the mixture was stirred to yield a conductive layer coating fluid.

This conductive layer coating fluid was applied to the surface of the support member by dipping, and the resulting coating film was dried and thermally hardened at 150° C. for 30 minutes to yield a 30 μm thick electroconductive layer.

Subsequently, 15 parts of N-methoxymethylated 6-nylon resin (product name: Tresin EF-30T, produced by Nagase Chemtex) and 5 parts of a copolymerized nylon resin (product name: Amilan CM8000, produced by Toray) were dissolved in a mixed solvent of 220 parts of methanol and 110 parts of 1-butanol to yield a coating liquid for forming an undercoat layer. This coating liquid was applied to the surface of the electroconductive layer by dipping, and the resulting coating film was dried at 100° C. for 10 minutes to yield a 0.65 μm thick undercoat layer.

Next, 2 parts of polyvinyl butyral (product name: S-LEC BX-1, produced by Sekisui Chemical) was dissolved in 100 parts of cyclohexanone. To the resulting solution was added 4 parts of crystalline hydroxygallium phthalocyanine (charge generation material) whose CuKαX-ray diffraction spectrum has peaks at Bragg angle 2θ of 7.4°±0.2° and 28.1°±0.2° . The mixture was subjected to dispersion at 23±3° C. for 1 hour in a sand mill with glass beads of 1 mm in diameter. After this dispersion, 100 parts of ethyl acetate was added to the dispersion liquid to yield a coating liquid for forming a charge generating layer. The resulting coating liquid was applied onto the undercoat layer by dipping, and the resulting coating film was dried at 90° C. for 10 minutes to yield a 0.20 μm thick charge generating layer.

Subsequently, 5 parts of the compound (charge transporting material) represented by formula (CTM-7) and 10 parts of polyester resin A synthesized in Synthesis Example 1 were dissolved in a mixed solvent of 33 parts of dimethoxymethane and 49 parts of cyclopentanone to yield a coating liquid for forming a charge transport layer.

The coating liquid for the charge transport layer was applied onto the surface of the charge generating layer by dipping, and the resulting coating film was dried at 130° C. for 30 minutes to yield a 23 μm thick charge transport layer (surface layer).

In this way, an electrophotographic photosensitive member was produced which includes the support member, the electroconductive layer, the undercoat layer, the charge generating layer, and the charge transport layer in this order.

Next, the resulting electrophotographic photosensitive member was evaluated as described below.

Examples 2 to 31

Electrophotographic photosensitive member samples were produced in the same manner as in Example 1, except that the polyester resin and the charge transporting material were replaced as shown in Table 2 in EXAMPLE 1.

Example 32

An electrophotographic photosensitive member sample was produced in the same manner as in Example 1, except that the undercoat layer was replaced as described below.

A coating liquid for an undercoat layer was prepared as follows: 8.5 parts of a compound represented by the following formula,

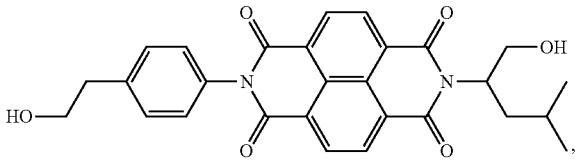

and 15 parts of a blocked isocyanate compound (product name: SBN-70D, produced by Asahi Kasei) as the charge transporting material, 0.97 parts of polyvinyl alcohol resin (product name: KS-5Z, produced by Sekisui Chemical) as resin, 0.15 parts of zinc(II) hexanoate (product name: Zinc(II) Hexanoate, produced by Mitsuwa Chemical) as a catalyst were dissolved in a mixed solvent of 88 parts of 1-methoxy-2-propanol and 88 parts of tetrahydrofuran. This coating liquid for the undercoat layer was applied to the surface of the electroconductive layer by dipping, and the resulting coating was dried and cured (polymerized) at 170° C. for 20 minutes to yield a 0.7 μm thick undercoat layer on the electroconductive layer.

Comparative Examples 1 to 10

Electrophotographic photosensitive member samples were produced in the same manner as in Example 1, except that the polyester resin and the charge transporting material were replaced as shown in Table 2 in EXAMPLE 1.

Comparative Example 11

An electrophotographic photosensitive member sample was produced in the same manner as in Example 1, except that the polyester resin was replaced by 5 parts of a polyester resin CE 2 or 5 parts of a polyester resin CE-3 in EXAMPLE 1.

[Evaluation]

<Evaluation of Charge Mobility>

Charge mobility was measured with a voltage direct application type electrophotographic: photosensitive member measuring apparatus using a curved NESA glass.

More specifically, the surface of the electrophotographic photosensitive member was brought into close contact with the NESA glass at a dark place. Then, voltage was applied to the NESA glass to charge the electrophotographic photosensitive member in such a way that the potential of the surface of the electrophotographic photosensitive member becomes a predetermined potential (Vd: −700 V). After the charge was kept for 0.5 seconds, the voltage applied to the NESA glass was turned off, and the electrophotographic photosensitive member was subjected to exposure immediately. The exposure amount was controlled so that the surface potential (V1) obtained 0.1 seconds after the exposure would be −500 V.

Figure 2:
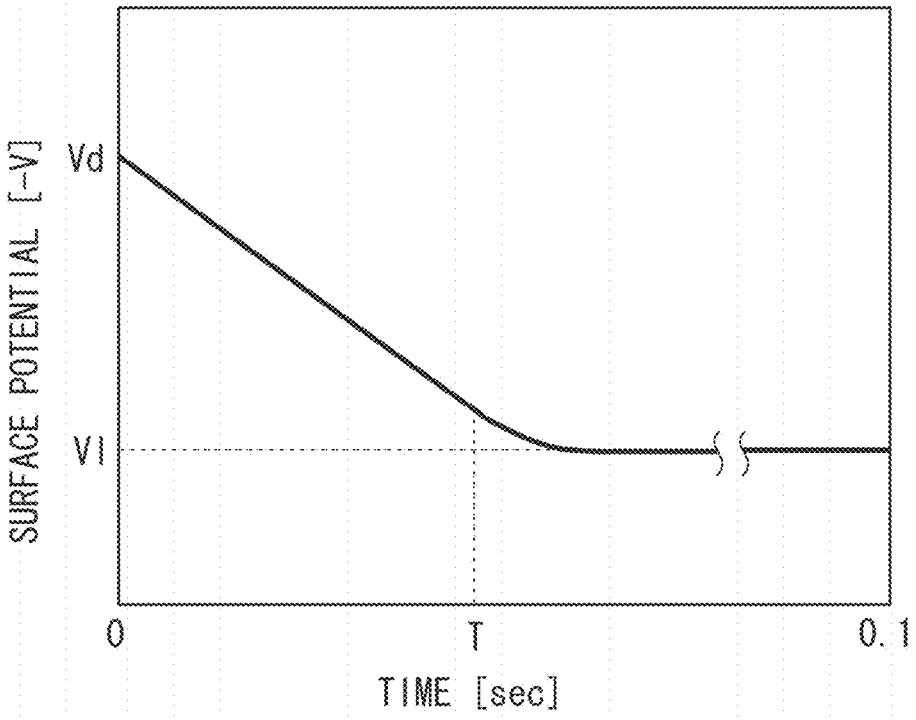
FIG. 2 illustrates a transition in potential of the surface of an electrophotographic photosensitive member in a charge mobility test.

FIG. 2 is a graph illustrating a transition in potential of the surface of an electrophotographic photosensitive member in this evaluation. The period immediately after exposure during which potential was changing linearly was calculated from the graph of FIG. 2 and was defined as a charge transport time T. Using the charge transport time T, the film thickness d of the charge transport layer, and the surface potential Vd set at the beginning of the measurement, charge mobility $\mu(cm^2/Vs)$ was calculated from the equation "$\mu=d^2/(Vd \cdot T)$".

<Evaluation of Durability>

As an evaluation apparatus, a laser printer manufactured by Hewlett-Packard Company (an apparatus modified from Color LaserJet Enterprise M552) (for printing 33 sheets per minute) was used. Each sample was evaluated under the environment of 15° C. in temperature and 10% RE in humidityAfter an. image pattern was printed on 5,000 sheets of A4-size plain paper in an intermittent mode in which printing was stopped every time one printed sheet was output, the decrease in the film thickness of the charge transport layer at the surface of the electrophotographic photosensitive member from the initial thickness was measured at the central portion thereof. For this measurement, a film thickness meter Fischer MMS with an eddy current probe EAW 3.3 manufactured by Fischer was used. For evaluation the decrease in film thickness of the charge transport layer obtained after 5,000-sheet image output was converted to the decrease for 1,000 sheets.

<Evaluation of Ghost Phenomenon Prevention Effect>

The above-mentioned laser printer was set in such a way as not to allow static electricity removing light to be emitted, the prepared electrophotographic photosensitive member was mounted in a process cartridge for black color, the process cartridge was mounted at a black process cartridge station, and images were output.

Each sample was evaluated under the environment of 23° C. in temperature and 50% RH in humidity. First, a full-color image (a text image with a printing ratio of 1% for each color) was printed on 5,000 sheets of A4-size plain paper, and, after that, images were sequentially output in the order of one solid white image, five ghost phenomenon evaluation images, one solid black image, and five ghost phenomenon evaluation images.

Figure 3:
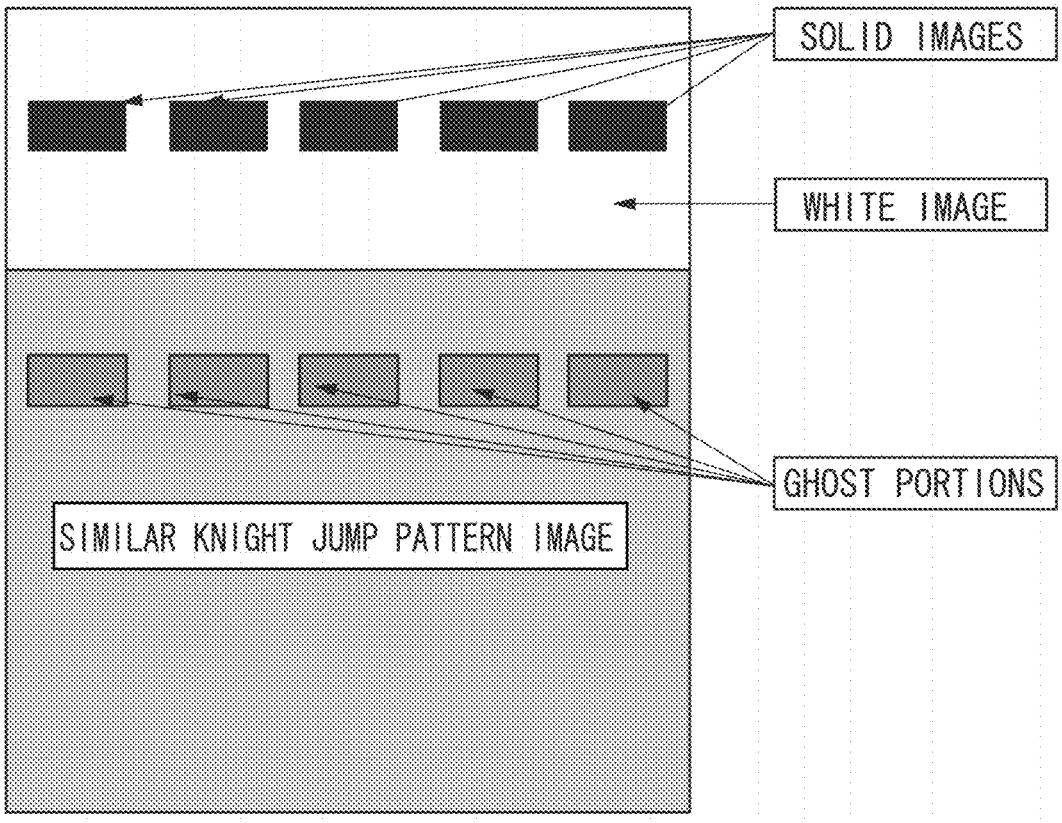
FIG. 3 illustrates an image for ghost phenomenon evaluation used in an exemplary embodiment.
Figure 4:
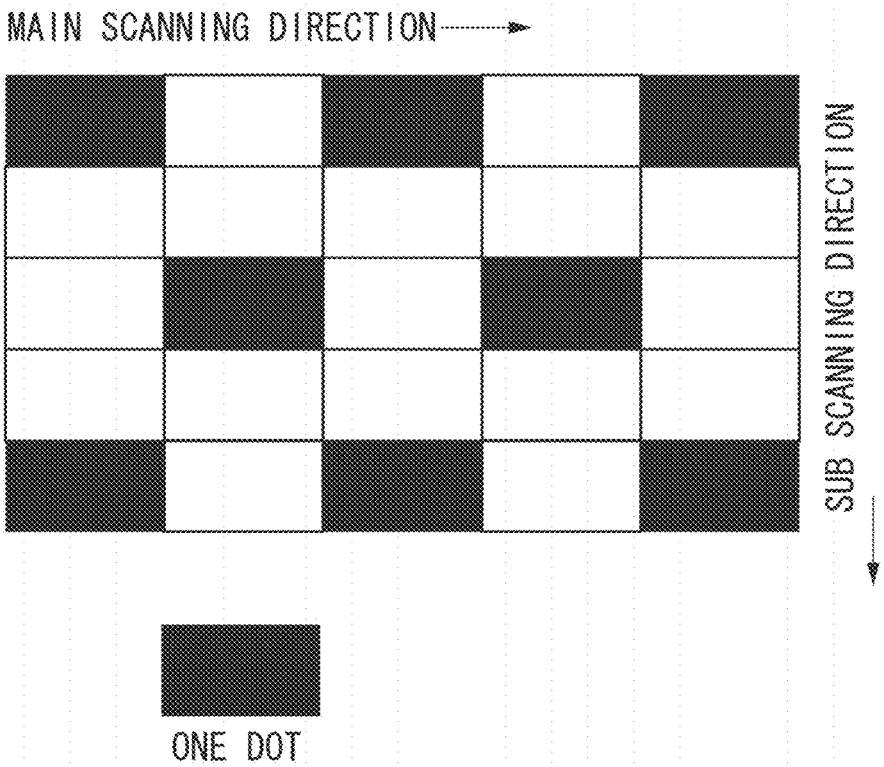
FIG. 4 illustrates a "halftone image with a similar knight lump pattern" illustrated in FIG. 3.

The ghost phenomenon evaluation image is an image obtained by, after outputting rectangular "solid images" into a "white image" at the leading portion of the image as illustrated in FIG. 3, forming a "halftone image of similar knight jump pattern" illustrated in FIG. 4. Furthermore, in FIG. 3, "ghost portions" are portions at which a ghost phenomenon caused by a "solid image" may occur.

The evaluation of a ghost phenomenon was conducted by measuring a difference in density between the image density of a halftone image of similar knight jump pattern and the image density of a ghost portion. A spectrodensitometer (product name: X-Rite 504/508, manufactured by X-Rite) was used to measure density differences at 10 points in one ghost phenomenon evaluation image. This measuring operation was performed on all of ten ghost phenomenon evaluation images, so that the average in 100 points in total was calculated to evaluate a Macbeth density difference.

TABLE 2

Preparation Conditions and Test Results of Electrophotographic Photosensitive Members

| | Preparation conditions | | | Test results | | |
|---|---|---|---|---|---|---|
| Example No. | Type and mass ratio of charge transporting material | Polyester resin No. | Mass of charge transporting material/mass of resin | Charge mobility $cm^2/Vs$ ($\times 10^{-6}$) | Durability: Decrease in film thickness (μm) | Ghost: Macbeth density difference |
| Example 1 | (CTM-7) | A | 5/10 | 9.3 | 0.29 | 0.022 |
| Example 2 | (CTM-7) | B | 5/10 | 10.2 | 0.33 | 0.022 |
| Example 3 | (CTM-7) | C | 5/10 | 9.1 | 0.32 | 0.023 |
| Example 4 | (CTM-7) | D | 5/10 | 8.8 | 0.33 | 0.022 |
| Example 5 | (CTM-7) | E | 5/10 | 7.8 | 0.34 | 0.023 |
| Example 6 | (CTM-7) | F | 5/10 | 8.5 | 0.36 | 0.025 |
| Example 7 | (CTM-7) | G | 5/10 | 5.5 | 0.11 | 0.028 |
| Example 8 | (CTM-7) | H | 5/10 | 7.1 | 0.20 | 0.025 |
| Example 9 | (CTM-7) | I | 5/10 | 6.6 | 0.17 | 0.026 |
| Example 10 | (CTM-7) | J | 5/10 | 5.4 | 0.12 | 0.028 |
| Example 11 | (CTM-7) | K | 5/10 | 4.1 | 0.13 | 0.029 |
| Example 12 | (CTM-7) | L | 5/10 | 6.4 | 0.18 | 0.027 |
| Example 13 | (CTM-7) | M | 5/10 | 7.3 | 0.27 | 0.026 |
| Example 14 | (CTM-7) | N | 5/10 | 7.2 | 0.26 | 0.026 |
| Example 15 | (CTM-7) | O | 5/10 | 5.5 | 0.21 | 0.028 |
| Example 16 | (CTM-7) | P | 5/10 | 4.4 | 0.24 | 0.031 |
| Example 17 | (CTM-7) | Q | 5/10 | 8.5 | 0.32 | 0.024 |
| Example 18 | (CTM-1) | J | 9/10 | 4.2 | 0.24 | 0.033 |
| Example 19 | (CTM-1) | L | 9/10 | 4.8 | 0.35 | 0.030 |

TABLE 2-continued

Preparation Conditions and Test Results of Electrophotographic Photosensitive Members

| | Preparation conditions | | | Test results | | |
|---|---|---|---|---|---|---|
| Example No. | Type and mass ratio of charge transporting material | Polyester resin No. | Mass of charge transporting material/mass of resin | Charge mobility $cm^2/Vs$ ($\times 10^{-6}$) | Durability: Decrease in film thickness (μm) | Ghost: Macbeth density difference |
| Example 20 | (CTM-3) | J | 9/10 | 4.4 | 0.23 | 0.030 |
| Example 21 | (CTM-4) | M | 6/10 | 5.5 | 0.30 | 0.029 |
| Example 22 | (CTM-5) | M | 7/10 | 6.1 | 0.32 | 0.028 |
| Example 23 | (CTM-6) | M | 7/10 | 5.8 | 0.31 | 0.025 |
| Example 24 | (CTM-8) | J | 6/10 | 5.8 | 0.19 | 0.027 |
| Example 25 | (CTM-9) | J | 4/10 | 6.0 | 0.14 | 0.026 |
| Example 26 | (CTM-4) | A | 6/10 | 9.2 | 0.28 | 0.031 |
| Example 27 | (CTM-5) | A | 7/10 | 8.8 | 0.30 | 0.030 |
| Example 28 | (CTM-1)/(CTM-2) (9/1) | A | 8/10 | 6.8 | 0.33 | 0.021 |
| Example 29 | (CTM-1)/(CTM-2) (9/1) | I | 8/10 | 5.7 | 0.24 | 0.022 |
| Example 30 | (CTM-1)/(CTM-3) (8/2) | H | 8/10 | 5.8 | 0.25 | 0.027 |
| Example 31 | (CTM-1)/(CTM-3) (8/2) | J | 10/10 | 4.8 | 0.24 | 0.029 |
| Example 32 | (CTM-7) | A | 5/10 | 9.3 | 0.29 | 0.020 |
| Comparative Example 1 | (CTM-7) | CE-1 | 5/10 | 3.8 | 0.37 | 0.068 |
| Comparative Example 2 | (CTM-7) | CE-2 | 5/10 | 3.6 | 0.60 | 0.075 |
| Comparative Example 3 | (CTM-7) | CE-3 | 5/10 | 3.7 | 0.42 | 0.078 |
| Comparative Example 4 | (CTM-7) | CE-4 | 5/10 | 3.5 | 0.44 | 0.075 |
| Comparative Example 5 | (CTM-7) | CE-5 | 5/10 | 1.8 | 0.39 | 0.095 |
| Comparative Example 6 | (CTM-1) | CE-1 | 9/10 | 3.5 | 0.55 | 0.068 |
| Comparative Example 7 | (CTM-3) | CE-2 | 9/10 | 3.3 | 0.73 | 0.075 |
| Comparative Example 8 | (CTM-4) | CE-3 | 6/10 | 3.6 | 0.56 | 0.084 |
| Comparative Example 9 | (CTM-5) | CE-4 | 7/10 | 3.8 | 0.54 | 0.089 |
| Comparative Example 10 | (CTM-6) | CE-5 | 7/10 | 2.2 | 0.46 | 0.077 |
| Comparative Example 11 | (CTM-7) | CE-2/CE-3 (5/5) | 5/10 | 3.8 | 0.52 | 0.074 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-106455 filed May 27, 2016, which is hereby incorporated by reference herein in its entirety.

What is claimed is:

1. An electrophotographic photosensitive member comprising:

a surface layer containing a charge transporting material and a polyester resin, wherein the polyester resin has a structure represented by general formula (I) and a structure represented by general formula (II):

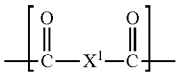

(I)

where, in general formula (I), $X^1$ represents a divalent group, and

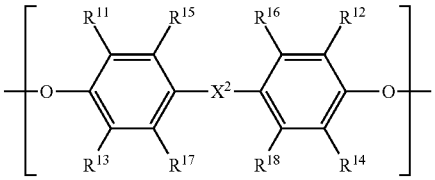

(II)

where, in general formula (II), $X^2$ represents a member selected from the group consisting of a single bond, an oxygen atom, a divalent alkylene group, and a divalent cycloalkylene group, and $R^{11}$ to $R^{18}$ each represent one of a hydrogen atom and an alkyl group, wherein the structure represented by general formula (I) includes a structure represented by formula (I-1):

(I-1)

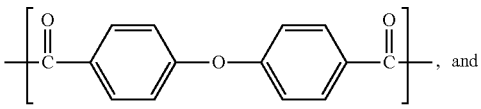

, and wherein the structure represented by general formula (II) includes a structure represented by general formula (II-1):

(II-1)

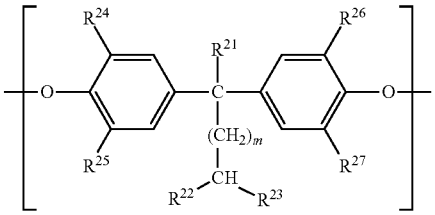

where, in general formula (II-1), $R^{21}$ represents a member selected from the group consisting of a hydrogen atom, a methyl group, an ethyl group, and a phenyl group, $R^{22}$ represents one of a methyl group and an ethyl group, $R^{23}$ represents an alkyl group with a carbon number of 1 to 4, $R^{24}$ to $R^{27}$ each represent one of a hydrogen atom and a methyl group, and m represents an integer of 0 to 3.

2. The electrophotographic photosensitive member according to claim 1, wherein a proportion of the structure represented by general formula (II-1) to the structure represented by general formula (II) in the polyester resin is 30% by mole or more.

3. The electrophotographic photosensitive member according to claim 1, wherein the polyester resin further has a structure represented by general formula (II-2) as the structure represented by general formula (II):

(II-2)

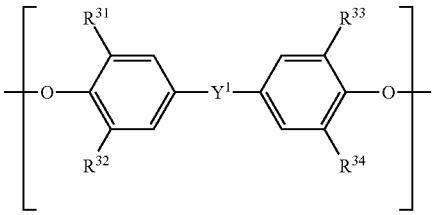

where, in general formula (II-2), $R^{31}$ to $R^{34}$ each represent one of a hydrogen atom and an alkyl group, $Y^1$ represents a member selected from the group consisting of a single bond, an oxygen atom, a divalent alkylene group, and a divalent cycloalkylene group.

4. The electrophotographic photosensitive member according to claim 3, wherein, in general formula (II-2), $Y^1$ represents a single bond.

5. The electrophotographic photosensitive member according to claim 3, wherein the structure represented by general formula (II-2) comprises a structure represented by formula (II-2-16):

formula (II-2-16)

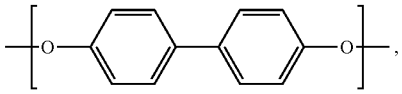

, wherein a proportion of the structure represented by formula (I-1) to the structure represented by general formula (I) in the polyester resin is 30% by mole or more, and wherein a proportion of the structure represented by general formula (II-1) to the structure represented by general formula (II) in the polyester resin is 30% by mole or more and 60% by mole or less, and wherein a proportion of the structure represented by formula (II-2-16) to the structure represented by general formula (II) in the polyester resin is 30% by mole or more and 60% by mole or less.

6. The electrophotographic photosensitive member according to claim 1, wherein a proportion of the structure represented by formula (II-1) to the structure represented by general formula (I) in the polyester resin is 30% by mole or more, and wherein a proportion of the structure represented by general formula (II-1) to the structure represented by general formula (II) in the polyester resin is 30% by mole or more.

7. A process cartridge comprising:

an integrally supported electrophotographic photosensitive member; and at least one integrally supported device selected from the group consisting of a charging device, a developing device, a transfer device, and a cleaning device, the process cartridge being detachably attachable to an electrophotographic apparatus, wherein the electrophotographic photosensitive member includes a surface layer containing a charge transporting material and a polyester resin, wherein the polyester resin has a structure represented by general formula (I) and a structure represented by general formula (II):

(I)

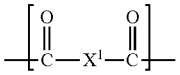

where, in general formula (I), $X^1$ represents a divalent group, and (II)

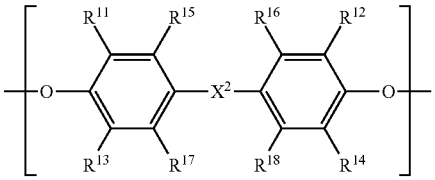

where, in general formula (II), $X^2$ represents a member selected from the group consisting of a single bond, an oxygen atom, a divalent alkylene group, and a divalent cycloalkylene group, and $R^{11}$ to $R^{18}$ each represent one of a hydrogen atom and an alkyl group, wherein the structure represented by general formula (I) includes a structure represented by formula (I-1):

(I-1)

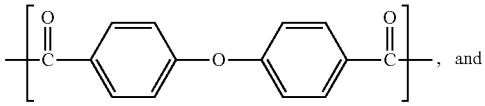

, and wherein the structure represented by general formula (II) includes a structure represented by general formula (II-1):

(II-1)

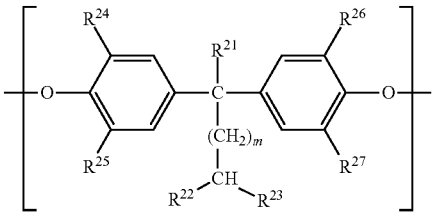

where, in general formula (II-1), $R^{21}$ represents a member selected from the group consisting of a hydrogen atom, a methyl group, an ethyl group, and a phenyl group, $R^{22}$ represents one of a methyl group and an ethyl group, $R^{23}$ represents an alkyl group with a carbon number of 1 to 4, $R^{24}$ to $R^{27}$ each represent one of a hydrogen atom and a methyl group, and m represents an integer of 0 to 3.

8. An electrophotographic apparatus comprising:

an electrophotographic photosensitive member;

a charging device;

an exposure device;

a developing device; and a transfer device, wherein the electrophotographic photosensitive member includes a surface layer containing a charge transporting material and a polyester resin, wherein the polyester resin has a structure represented by general formula (I) and a structure represented by general formula (II):

(I)

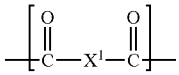

where, in general formula (I), $X^1$ represents a divalent group, and (II)

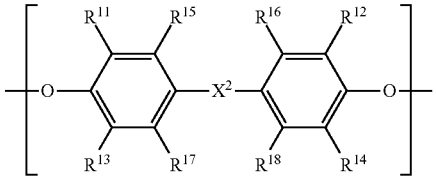

where, in general formula (II), $X^2$ represents a member selected from the group consisting of a single bond, an oxygen atom, a divalent alkylene group, and a divalent cycloalkylene group, and $R^{11}$ to $R^{18}$ each represent one of a hydrogen atom and an alkyl group, wherein the structure represented by general formula (I) includes a structure represented by formula (I-1):

(I-1)

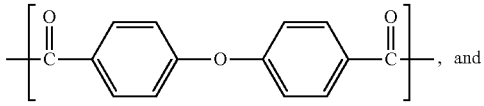

, and wherein the structure represented by general formula (II) includes a structure represented by general formula (II-1):

(II-1)

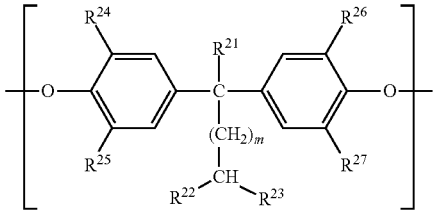

where, in general formula (II-1), $R^{21}$ represents a member selected from the group consisting of a hydrogen atom, a methyl group, an ethyl group, and a phenyl group, $R^{22}$ represents one of a methyl group and an ethyl group, $R^{23}$ represents an alkyl group with a carbon number of 1 to 4, $R^{24}$ to $R^{27}$ each represent one of a hydrogen atom and a methyl group, and m represents an integer of 0 to 3.

* * * * *